US011707937B2

(12) United States Patent
Sugiura

(10) Patent No.: US 11,707,937 B2
(45) Date of Patent: Jul. 25, 2023

(54) IMAGE RECORDING APPARATUS

(71) Applicant: Brother Kogyo Kabushiki Kaisha, Nagoya (JP)

(72) Inventor: Keita Sugiura, Toyokawa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/345,018

(22) Filed: Jun. 11, 2021

(65) Prior Publication Data

US 2021/0402808 A1 Dec. 30, 2021

(30) Foreign Application Priority Data

Jun. 24, 2020 (JP) ..... 2020-108607

(51) Int. Cl.
*B41J 29/38* (2006.01)
*B41J 11/42* (2006.01)
*B41J 29/02* (2006.01)

(52) U.S. Cl.
CPC ..... *B41J 11/42* (2013.01); *B41J 29/02* (2013.01)

(58) Field of Classification Search
None
See application file for complete search history.

(56) References Cited

U.S. PATENT DOCUMENTS 3,856,128 A 12/1974 Taggart
6,722,238 B2 4/2004 Shinga
2011/0229241 A1 9/2011 Takahashi
2012/0249625 A1* 10/2012 Asada ..... B41J 2/17546 347/3
2014/0099150 A1 4/2014 Matsumoto et al.
2016/0041515 A1 2/2016 Numazu et al.
(Continued)

FOREIGN PATENT DOCUMENTS

EP 1 101 718 A2 5/2001
JP 2004114363 A * 4/2004
JP 2006016167 A * 1/2006 ..... B41J 11/0095
(Continued)

OTHER PUBLICATIONS

Inena, Katsuya, Paper Feeding Device, Jan. 19, 2006, Japan, All (Year: 2006).*
(Continued)

*Primary Examiner* — Erica S Lin
*Assistant Examiner* — Tracey M McMillion
(74) *Attorney, Agent, or Firm* — Burr Patent Law, PLLC

(57) ABSTRACT

There is provided an image recording apparatus which is provided with a housing, a holder configured to be drawable from the housing, a supporting member supported by the holder and configured to support a sheet roll, a liquid container supported by the holder and configured to hold liquid, a conveyance mechanism arranged in an inner space of the housing and configured to convey a sheet unwound from the sheet roll, and a print head arranged in the inner space of the housing and configured to record an image on the sheet conveyed by the conveyance mechanism. The liquid container is configured to include at least one of tanks configured to hold liquid to be provided to the print head and a waste tank configured to pool liquid discharged from the print head.

10 Claims, 6 Drawing Sheets

(56) References Cited

U.S. PATENT DOCUMENTS

2018/0290854 A1 10/2018 Foreman

FOREIGN PATENT DOCUMENTS

| | | | |
|---|---|---|---|
| JP | 4775646 | B2 * | 9/2011 |
| JP | 2015-120578 | A | 7/2015 |
| JP | 2018-075792 | A | 5/2018 |

OTHER PUBLICATIONS

Yamamoto, Printer, Sep. 21, 2011, Japan, All (Year: 2011).*
Iemura, Hirotoshi, Ink Jet Image Forming Apparatus, Apr. 15, 2004, Japan, All (Year: 2004).*
U.S. Office Action (U.S. Appl. No. 17/346,396) dated Aug. 1, 2022.

* cited by examiner

IMAGE RECORDING APPARATUS

CROSS-REFERENCE TO RELATED APPLICATIONS

This application claims priority under 35 U.S.C. § 119 from Japanese Patent Application No. 2020-108607 filed on Jun. 24, 2020. The entire subject matter of the application is incorporated herein by reference.

BACKGROUND

Technical Field

The present disclosures relate to an image recording apparatus configured to form an image on a sheet unwound from a sheet roll attached to a supporting member.

Related Art

There has been known an image recording apparatus configured to form an image on a sheet unwound from a roll body (i.e., a sheet roll), which is a continuous recording sheet in a rolled form.

The roll body is attached to an attachment member in an inner space of a housing of the image recording apparatus. Typically, a roll body insertion opening through which the roll body is exchanged is formed on the housing of the image recording apparatus. Further, an external cover is provided to the housing such that the roll body insertion opening is opened and closed by the external cover.

SUMMARY

When the image recording apparatus is an inkjet printer, an ink cartridge configured to hold ink to be used for printing and a waste ink storage configured to retain waste ink are provided in the inner space of the housing. Both the cartridge and the waste ink storage are components to be replaced by a user. When the ink cartridge is replaced, an external cover provided on a front surface of the housing of the image recording apparatus may be opened, while, when the waste ink storage is replaced, another external cover provided on a side surface of the housing of the image recording apparatus may be opened.

Various components such as the roll body, the ink cartridge, the waste storage and the like to be replaced by the user are arranged in the inner space of the housing of the image recording apparatus. When the locations of the covers and operating directions thereof for replacing respective components are different, an unaccustomed user may have difficulty in identifying an appropriate cover to replace a component.

According to aspects of the present disclosures, there is provided an image recording apparatus which is provided with a housing, a holder configured to be drawable from the housing, a supporting member supported by the holder and configured to support a sheet roll, a liquid container supported by the holder and configured to hold liquid, a conveyance mechanism arranged in an inner space of the housing and configured to convey a sheet unwound from the sheet roll, and a print head arranged in the inner space of the housing and configured to record an image on the sheet conveyed by the conveyance mechanism. The liquid container is configured to include at least one of tanks configured to hold liquid to be provided to the print head and a waste tank configured to pool liquid discharged from the print head.

DETAILED DESCRIPTION OF THE EMBODIMENT

Hereinafter, an image recording apparatus 10 according to an embodiment of the present disclosures will be described with reference to the accompanying drawings. It should be noted that an embodiment described below is only an illustrative example and various modifications and/or improvements of the embodiment can be made without departing from aspects of the present disclosures.

In the following description, a one-way direction from one point toward another point will be referred to as a one-way direction, while a both-way direction between one point and another point will be referred to simply as a direction or a both-way direction.

In the following description, a vertical direction (an up-down direction) 7, which is a both-way direction, is defined with reference to a state in which the image recording apparatus 10 is installed and ready for use (i.e., a state shown in FIG. 1). Further, a front-rear direction 8, which is also a both-way direction, is defined regarding a side in which a discharge opening 13 is provided as a front side, and a right-left direction 9, which is also a both-side direction, is defined with the image recording apparatus 10 viewed from its front side. Furthermore, right, left, front, rear, up and down sides are indicated by arrows in each of FIG. 1-4.

Appearance of Image Recording Apparatus

Figure 1:
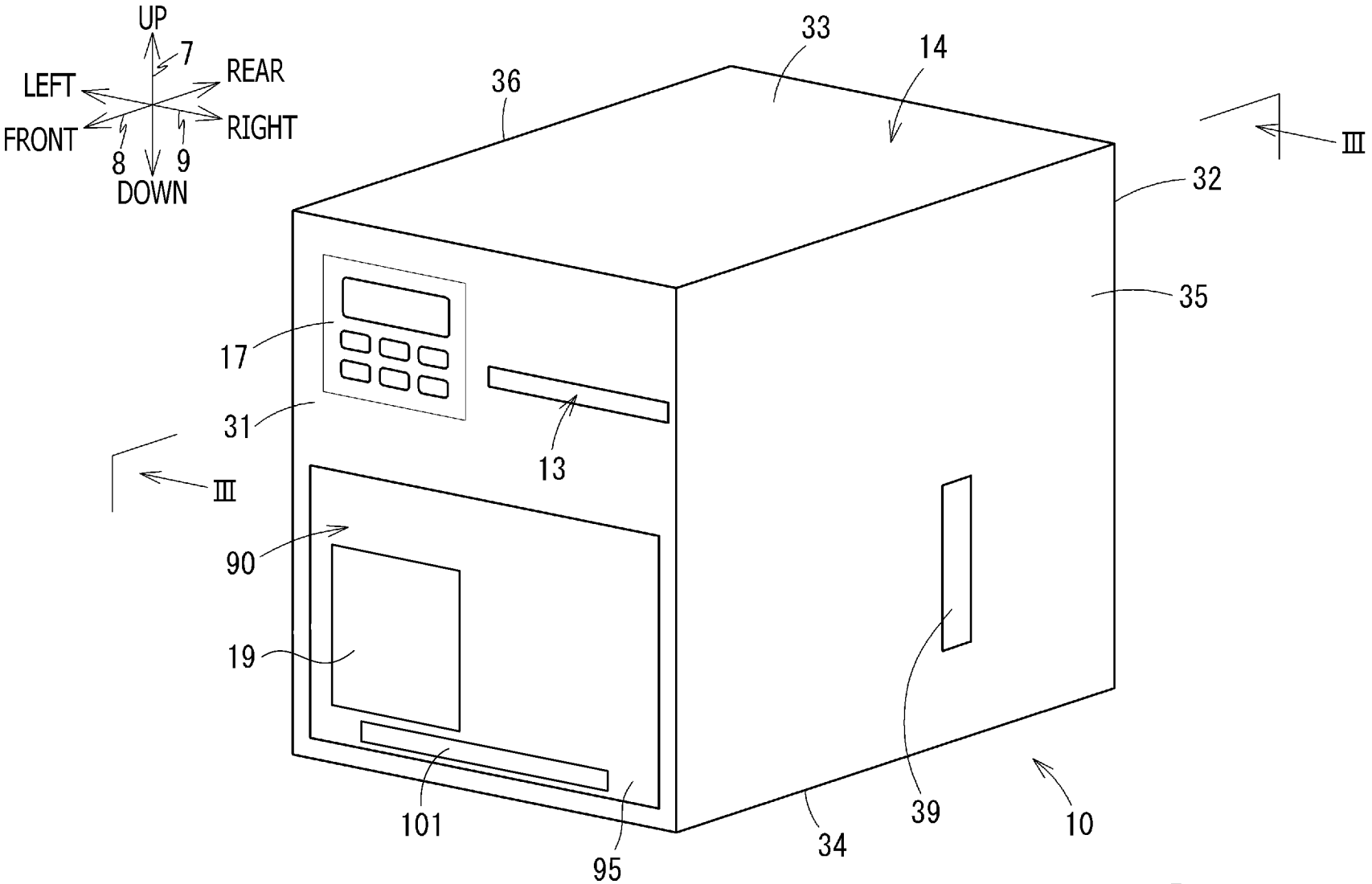
FIG. 1 is a perspective view of an image recording apparatus according to an embodiment of the present disclosures when a holder is attached to a housing.

FIG. 1 is a perspective view of the image recording apparatus 10 which is configured to form an image onto a continuous sheet unwound from a roll body 11 (see FIG. 3) in accordance with an inkjet printing method.

The image recording apparatus 10 has a housing 14, which has an approximately rectangular parallelopiped shape. An inner space of the housing 14 is defined by walls. As shown in FIG. 1, the housing 14 has a right wall 35 and a left wall 36, which are arranged to face and be spaced from each other in the right-left direction 9, an upper wall 33 and a lower wall 34, which are arranged to face and to be spaced from each other in the up-down direction 7, and a front wall 31 and a rear wall 32, which are arranged to face and to be spaced in the front-rear direction 8. Each of the upper wall 33 and the lower wall 34 connects the right wall 35 and the left wall 36, and each of the front wall 31 and the rear wall 32 connects the upper wall 33 and the lower wall 34.

The housing 14 has a suitable size such that the image recording apparatus 10 can be placed and used on a desk. However, it is also possible to install and use the image recording apparatus 10 on the floor.

As mentioned above, the discharge opening 13 is formed on the front wall 31. The discharge opening 13 is a through opening penetrating through the front wall 31. Through the discharge opening 13, the inner space of the image recording apparatus 10 communicates with the outside. An operation panel 17 is arranged on the left side with respect to the discharge opening 13 on the front wall 31. The operation panel 17 has a display and input keys. The user can input various operation commands and the like to operate the image recording apparatus 10 through the operation panel 17.

Figure 2:
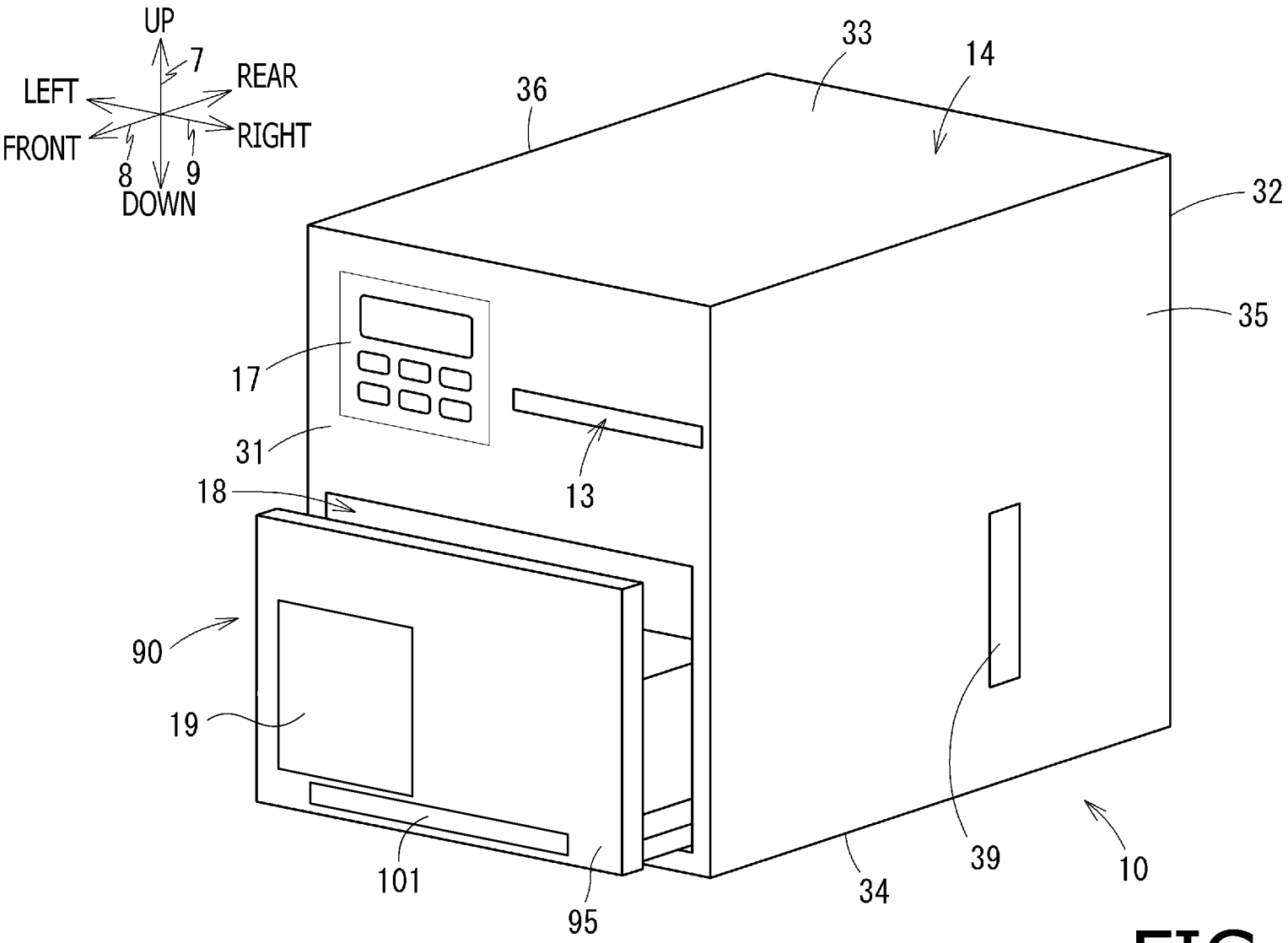
FIG. 2 is a perspective view of the image recording apparatus with the holder being drawn from the housing.

As shown in FIG. 2, a drawing opening 18 is formed below the discharge opening 13 and the operation panel 17 on the front wall 31. The inner space of the housing 14 communicates with the outside through the drawing opening 18. A holder 90 can be inserted in and drawn from the housing 14 of the image recording apparatus 10 through the drawing opening 18. As shown in FIG. 1, when the holder 90 is fully inserted in (i.e., attached to) the housing 14, a holder outer wall 95 of the holder 90 forms a part of an outer wall of the housing 14 in association with the front wall 31.

A window 19 is formed on the holder outer wall 95. The window 19 is located below the operation panel 17 when the holder 90 is fully inserted in the housing 14. The window 19 is formed with a transparent element that is fitted in a through-opening that penetrates the holder outer wall 95. The window 19 enables a visual inspection of a tank (or a plurality of tanks) 70 located in the inner space of the housing 14 from the outside. Although the size and shape of the window 19 are not necessarily limited to particular ones, it is desirable that the window 19 enables the user to check the remaining amount of the ink held in the tank 70. For example, a lower end of the window 19 may be located around a lower end of the tank 70, and an upper end of the window 19 may be located around an upper end of the tank 70. It is noted that the window 19 may be a through-opening instead of the one provided with the transparent element.

Another window 39 is provided on the right wall 35. The window 39 is formed with a transparent element that is fitted in a through-opening formed on the right wall 35. The window 39 enables a user to visually inspect a remaining amount of the sheet of the roll body 11 arranged in the inner space of the housing 14 from the outside. The window 39 is located on a left side with respect to a spindle 92 (see FIG. 3: a closer side with respect to a plane of FIG. 3). Although the size and shape of the window 39 are not necessarily limited to particular ones, it is preferable that the window 39 enables the user to easily check the remaining amount of the sheet of the roll body 11 held by the spindle 92. For example, a lower end of the window 39 may be located around the spindle 92, while an upper end of the window 39 may be located around the upper end of a new roll body 11 held by the spindle 92. It is noted that the window 39 may be a through-opening instead of the one provided with the transparent element.

As shown in FIGS. 1 and 2, a finger grip 101 is formed on a lower end portion of the holder outer wall 95. The finger grip 101 is formed to be a concave portion or protruded portion with respect to the holder outer wall 95 so that the user can hook a finger when drawing the holder 90.

In a state where the holder 90 is attached to the housing 14 (i.e., fully inserted into the housing 14 through the opening 18), the finger grip 101 is exposed to the outside of the housing 14. Therefore, in a state where the holder 90 is attached to the housing 14 (as shown in FIG. 1), the user can hold the finger grip 101 by inserting his finger into the finger grip 101 from the front side. It is noted that the finger grip 101 may have another shape such as a part of a C-shaped member protruding frontward.

Internal Structure of Image Recording Apparatus

Figure 3:
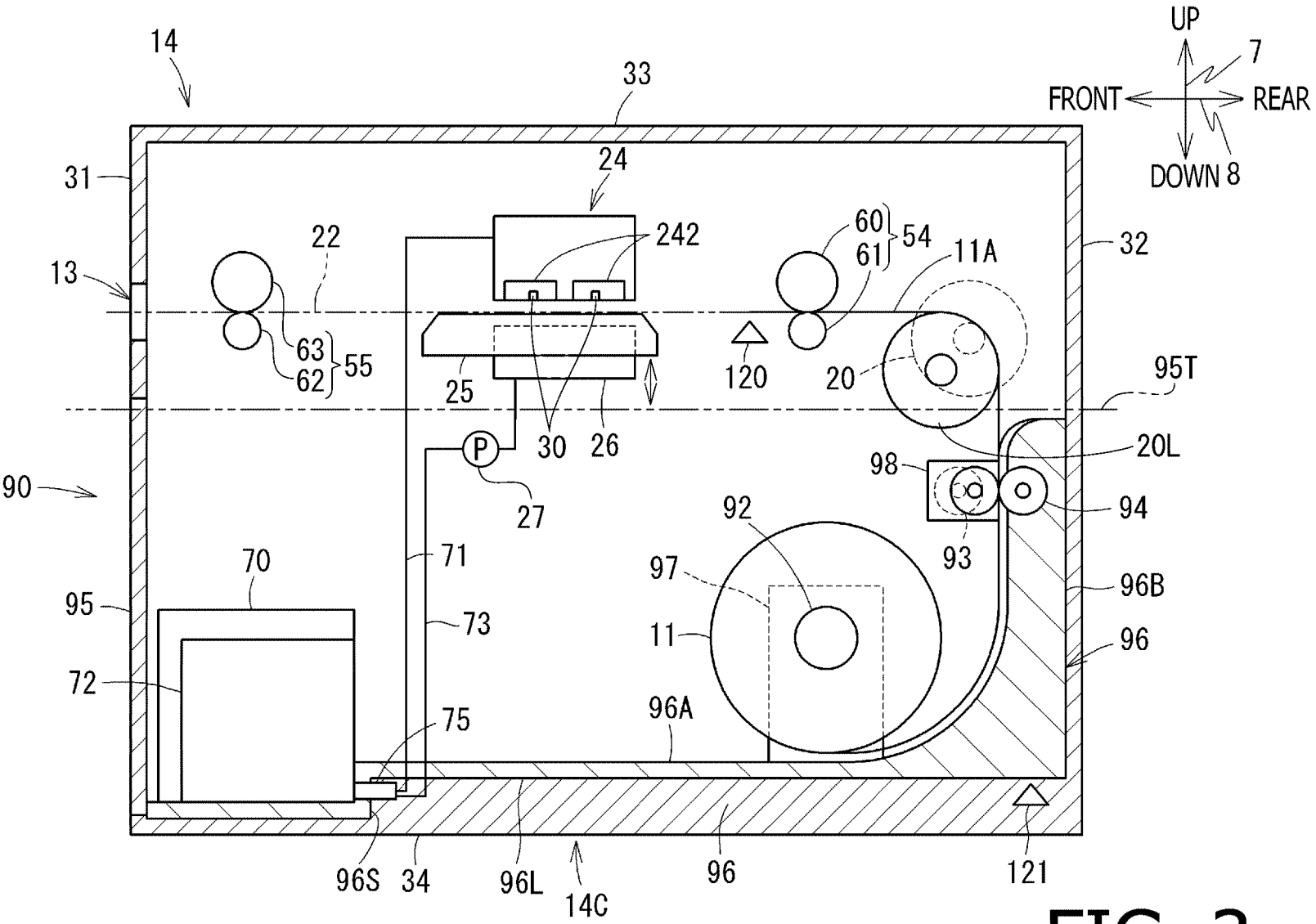
FIG. 3 is a cross-sectional side view of the image recording apparatus taken along line III-III shown in FIG. 1.

As shown in FIG. 3, a conveyance path 22 is defined in the inner space of the housing 14. In the inner space of the housing 14, a guide roller 20, a first conveyance roller pair 54 (i.e., rollers 60 and 61), a second conveyance roller pair 55 (i.e., rollers 62 and 63), a platen 25, a cap 26 and a pump 27 are provided. Although not shown in FIG. 3, a maintenance unit for a print head 24 and a power supply may also be provided in the inner space of the housing 14.

The print head 24 includes discharge modules 242. Each of the discharge modules 242 is configured such that a plurality of nozzles 30 is arranged side by side along the right-left direction 9. Ink droplets are discharged downward from the plurality of nozzles 30 toward the platen 25. Although only two rows of nozzles 30 spaced in the front-rear direction 8 are shown in FIG. 3, more than two rows of nozzles may be arranged in the front-rear direction 8, and each row has a plurality of nozzles 30 arranged in the right-left direction 9.

The guide roller 20 is arranged in the inner space of the housing 14 and in the vicinity of the rear wall 32. The guide roller 20 is a cylindrical roller of which a rotation axis extends in the right-left direction 9. A sheet 11A, which is unwound and led upward from the roll body 11, is wound around the guide roller 20 and extends frontward toward the front wall 31. On a circumferential surface (i.e., a roller surface) of the guide roller 20, a surface opposite to a printing surface of the sheet 11A contacts.

The guide roller 20 is configured to move between a first position indicated by the solid line in FIG. 3, and a second position indicated by the broken line in FIG. 3. The first position is a position on an inner side at a concave curvature of the curved portion of the conveyance path 22 compared to the second position. Although not shown in FIG. 3, the guide roller 20 is urged by an elastic member such as a spring toward the second position.

As the sheet 11A unwound from the roll body 11 wraps around the guide roller 20, and held by the first conveyance roller pair 54 and the nip rollers 93 and 94, a tension of the sheet 11A therebetween is applied to the guide roller 20, thereby the guide roller 20 being urged to be moved from the second position and located at the first position. A lower part 20L, which is a part of the guide roller 20, is located below an upper end of the guide roller 20 is located on a lower side with respect to an upper end of the holder outer wall 95 in a state where the holder 90 is attached to the housing 14. The outer wall 95 of the holder 90 is indicated by broken lines in FIG. 3.

As shown in FIG. 3, the conveyance path 22 is formed from a position in the vicinity of an upper rear end portion of the holder 90 to the discharge opening 13 via the guide roller 20.

There are provided guide members (not shown) to the holder 90. The guide members define the conveyance path 22 having a concavely curved guide surface at a portion facing the guide roller 20 so that the conveyance path 22 from the upper rear end portion of the holder 90 changes its extending direction from the up-down direction 7 to the front-rear direction 8 at the guide roller 20, and then extends to the first conveyance roller pair 54.

A part of the conveyance path 22 from the guide roller 20 to the discharge opening 13 extends substantially linearly in the front-rear direction 8. The conveyance path 22 is a path through which the sheet 11A is conveyed. The conveyance path 22 is defined by the guide members, which are arranged to be spaced in the up-down direction 7, the guide roller 20, the print head 24 and the platen 25. Between the guide roller 20 and the discharge opening 13, a frontward direction, which is the one-way direction, is the conveying direction of the sheet 11A in the conveyance path 22.

As shown in FIG. 3, the first conveyance roller pair 54 is provided along the conveyance path 22 in the inner space of the housing 14, at a position on a downstream side in the conveying direction, with respect to the guide roller 20 and on an upstream side, in the conveying direction, with respect to the print head 24. The first conveyance roller pair 54 has a first conveyance roller 60 and a pinch roller 61. The second conveyance roller pair 55 is provided along the conveyance path 22 in the inner space of the housing 14 at a position on a downstream side, in the conveyance direction, with respect to the print head 24. The second conveyance roller pair 55 has a second conveyance roller 63 and a pinch roller 62. The first conveyance roller 60 and the second conveyance roller 62 rotate as a rotation force of a motor 102 (see FIG. 5) is transmitted. The pinch roller 61 is urged toward the first conveyance roller 60, and the pinch roller 62 is urged toward the second conveyance roller 63. The first conveyance roller pair 54 and the second conveyance roller pair 55 convey the sheet 11A in the conveying direction along the conveyance path 22 as the first conveyance roller 60 and the pinch roller 61 hold the sheet 11A therebetween and rotate, and the second conveyance roller 63 and the pinch roller 62 hold the sheet 11A therebetween and rotate.

As shown in FIG. 3, the print head 24 and the platen 25 are arranged between the first conveyance roller pair 54 and the second conveyance roller pair 55, and on opposite sides with respect to the conveyance path 22.

As shown in FIG. 3, the platen 25 is arranged below the print head 24. An upper surface of the platen 25 is configured to be parallel to a surface of the print head 24 on which orifices for respective nozzles 30 are formed. A dimension of the upper surface of the platen 25 in the right-left direction 9 is larger than a dimension of the roll body 11 in the right-left direction 9. The upper surface of the platen 25 supports, from below, the sheet 11A conveyed by the first conveyance roller pair 54 and the second conveyance roller pair 55. Although not shown in FIG. 3, it is also possible to have the sheet 11A attracted onto the upper surface of the platen 25 by electrostatic force or negative pressure. Since the platen 25 is not fixed to the holder 90, the platen 25 stays unmoved in the inner space of the housing 14 when the holder 90 is drawn from the housing 14.

Further, as shown in FIG. 3, the cap 26 is arranged below the print head 24 and on the left side (i.e., in a farther direction with respect to a plane of FIG. 3) with respect to the platen 25. The print head 24 is configured to move in the right-left direction 9. When the printing is performed on the sheet 11A, the print head 24 is located above the platen 25. When the printing is not performed or the maintenance is performed, the print head 24 is located above the cap 26. The cap 26 is configured to move in the vertical direction 7. When the print head 24 is to be moved, the cap 26 is located at a lower position and does not contact the print head 24.

When the maintenance of the print head 24 is to be performed or when the image recording apparatus 10 is in a standby mode, the cap 26 is located at an upper position and comes in contact with a lower surface of the print head 24. In this state, the cap 26 covers nozzle openings of all the nozzles 30 of the discharge module 242. An inner space of the cap 26 communicates with a waste tank 72 via a tube 73. A pump 27 is provided to the tube 73 at a position between the cap 26 and the waste tank 72. When the pump 27 is driven, the inner space of the cap 26 has a negative pressure, and the ink is sucked from the nozzles 30 to the inner space of the cap 26. The ink sucked to the inner space of the cap 26 flows to the waste tank 72 via the tube 73. Such a process of sucking the ink from the nozzles 30 is known as "purging."

As shown in FIG. 3, a sheet sensor 120 is provided at a position on the downstream side, with respect to the first conveyance roller pair 54 and on the upstream side with respect to the platen 25 in the conveyance direction. The sheet sensor 120 outputs different signals depending on the presence or absence of the sheet 11A. In other words, the sheet sensor 120 outputs a detection signal indicating whether the sheet 11A is present or absent at a position where the sheet sensor 120 is located. A controller 130 (see FIG. 5) is configured to receive the signal output by the sheet sensor 120.

As shown in FIG. 3, an attachment sensor 121 is provided on the lower wall 34 of the housing 14, in the vicinity of the rear wall 32. The attachment sensor 121 is configured to output different signals depending on the presence or absence of the holder 90. In other words, the attachment sensor 121 outputs a detection signal indicating whether the holder 90 is attached to the housing 14 or not. The signal output by the attachment sensor 121 is received by the controller 130 (see FIG. 5).

Configuration of Holder

As shown in FIGS. 1 and 2, the holder 90 is configured to be drawn from and inserted in the housing 14, in the front-rear direction 8, through the drawing opening 18 formed on the front wall 31 of the housing 14.

Figure 4:
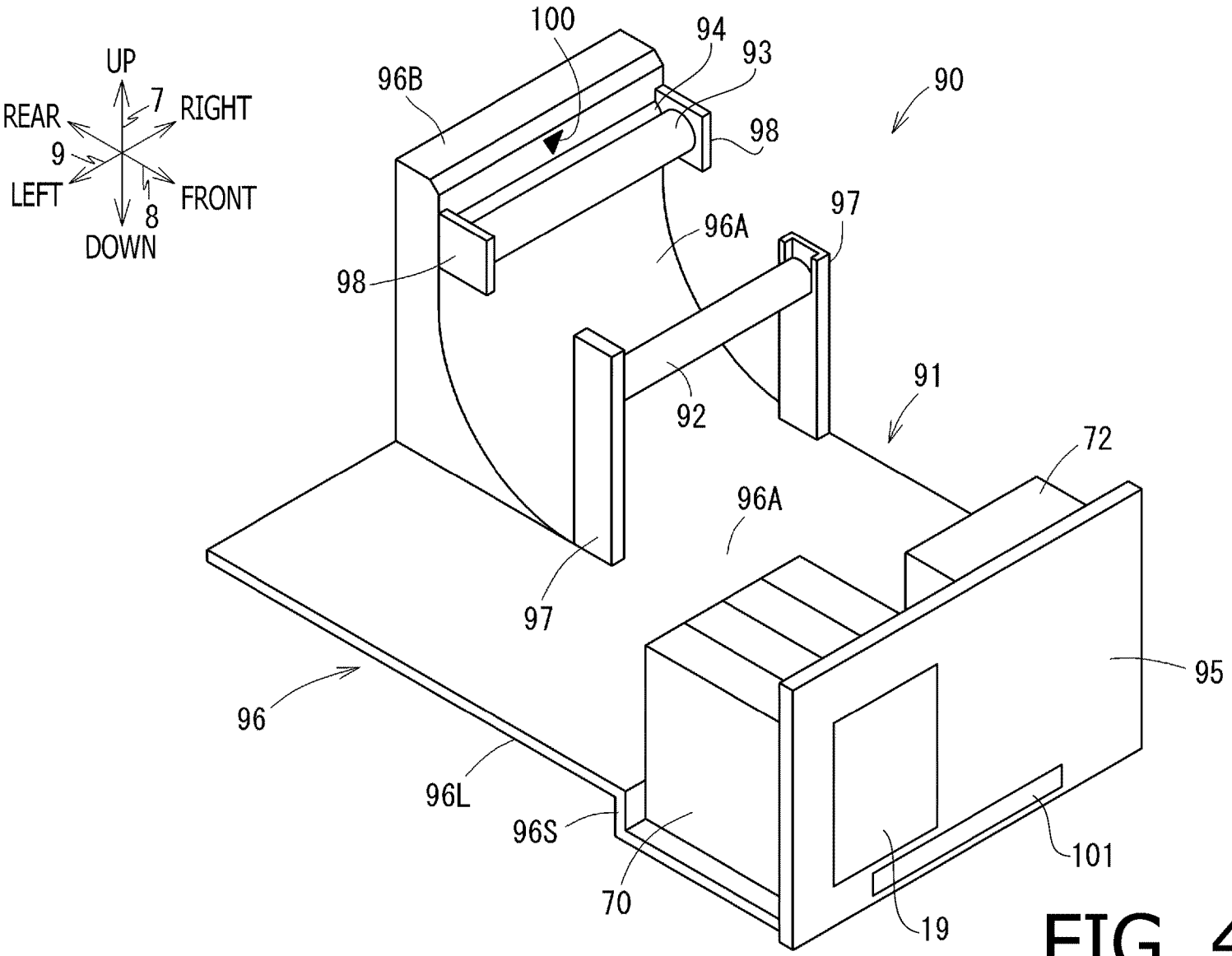
FIG. 4 is a perspective view of the holder.

As shown in FIGS. 3 and 4, The holder 90 has a holder chassis 91, the spindle 92, the nip rollers 93 and 94, the tank 70 and the waste tank 72.

The holder chassis 91 has the holder outer wall 95 and a main body 96. A front surface of the main body 96 is connected to the holder outer wall 95. The holder outer wall 95 closes the drawing opening 18 when the holder 90 is fully inserted in the inner space of the housing 14 through the drawing opening 18 (see FIG. 1). In this state (i.e., when the holder 90 is fully inserted in the housing 14), the outer surface of the holder outer wall 95 and the outer surface of the front wall 31 of the housing 14 are on the same plane.

The main body 96 has an approximately L-shaped side view, and has a lower portion 96L extending along the lower wall 34 of the housing 14 and a rear portion 96B extending along the rear wall 32 of the housing 14. The lower portion 96L is supported by the lower wall 34 of the housing 14. A length of the lower portion 96L in the front-rear direction 8 is slightly shorter than a length of the lower wall 34 of the housing 14. The lower portion 96L has a step 96S. An upper surface of a frontward part of the lower portion 96L with respect to the step 96S is formed to be lower than an upper surface of a rearward part of the lower portion 96L with respect to the step 96S.

There are provided the tank 70 and the waste tank 72 on the front side, with respect to the step 96S, of the lower portion 96L. The tank 70 and the waste tank 72 are arranged side by side in the right-left direction 9 with the tank 70 being arranged on the left side. The tank 70 stores the ink. The tank 70 is of a cartridge type and is configured to be detachably attached to the holder 90. The ink stored in each tank 70 is supplied to the print head 24 (see FIG. 3) via a tube 71. The tank 70 is made of a transparent material, which enables a user to observe a level (i.e., a remaining amount)

of the ink held therein. Multiple tanks 70 (e.g., for multiple colors) may be arranged side by side in the right-left direction 9.

In the illustrative embodiment shown in FIG. 4, four tanks 70 are arranged side by side in the right-left direction 9. The ink is a liquid that contains pigments and other substances. The ink has a viscosity suitable for uniformly dispersing the pigment. The pigment defines the color of the ink.

The waste tank 72 is a container configured to pool the ink in the inner space thereof. The inner space of the waste tank 72 may be a cavity or a space filled with material which absorbs and holds the ink. The waste tank 72 is also detachably attached to the holder 90.

As shown in FIG. 3, a joint 75 is formed to protrude rearward from the step 96S. Although only one joint 75 is shown in FIG. 3, according to the present embodiment, five joints 75 are provided spaced from each other in the right-left direction 9. The five joints 75 correspond to the four tanks 70 and the waste tank 72, respectively. Four of the five joints 75 are connected to the four tanks 70, respectively, while the other is connected to the waste tank 72 to allow the liquid (i.e., ink) to flow therethrough. The tank 70 and the waste tank 72 are attached to or detached from the joints 75 as they are attached to or detached from the holder 90.

Although not shown in the FIG. 3, five joint receivers configured to connectively receive the respective joints 75 are provided on the lower wall 34 of the housing 14. In a state where the holder 90 is attached to the housing 14, the joints 75 are connected to the joint receivers such that the liquid can be flown therethrough. The five joint receivers are arranged to be spaced, in the right-left direction 9, from each other so as to correspond to the two joints 75.

To the joint receivers which are connected to the joints 75, one ends of the tubes 71 corresponding to the respective tanks 70 are connected. To the joint receiver which is connected to the joint 75 corresponding to the waste tank 72, one end of the tube 73 is connected.

As shown in FIGS. 3 and 4, an upper surface of a right side portion of the lower portion 96L and an inner surface of the rear portion 96B (a surface facing frontward) are continuously connected to form a curved surface 96A. The curved surface 96A faces upward and frontward. The curved surface 96A is configured to guide the sheet 11A unwound from the roll body 11.

The main body 96 has supporting members 97 supporting both ends of the spindle 92, respectively, and supporting members 98 supporting both ends of the nip roller 93, respectively. The two supporting members 97 are arranged in the right-left direction 9, one being provided at the right end of the main body 96 and the other being provided at a substantially central portion, in the right-left direction 9, of the main body 96. Each of the two supporting members 97 extends upward from the lower portion 96L.

The two supporting members 98 are arranged in the right-left direction 9, one being provided at the right end of the main body 96, which is the right end of the curved surface 96A, and the other being provided at the left end of the curved surface 96A. Each of the two supporting members 98 extends frontward from the curved surface 96A.

The two supporting members 97 are arranged to face each other in the right-left direction 9, and the two supporting members 98 are also arranged to face each other in the right-left direction 9. The spindle 92 is arranged on the rear side with respect to the tank 70 and the waste tank 72. As shown in FIG. 3, the spindle 92 is arranged on the rear side, in the front-rear direction 8, with respect to the discharge opening 13. The guide roller 20 is arranged on the rear side, in the front-rear direction 8, with respect to the spindle 92.

The spindle 92 extending in the right-left direction 9 is arranged on an inner side of curvature of the curved surface 96A of the main body 96. Both ends of the spindle 92 are rotatably supported by the supporting members 97, respectively. The spindle 92 is detachably attached to the supporting members 97. The spindle 92 is inserted into the center (i.e., a hollow core) of the roll body 11 and supports the roll body 11. The spindle 92 is rotated by a rotating force transmitted from the motor 102 arranged in the inner space of the housing 14.

Although not shown in FIG. 4, there is a hole in the left supporting member 97, and a left end of the spindle 92 is inserted through the hole and rotatably supported thereby. The left end of the spindle 92 is connected to a transmission mechanism (e.g., a gear train) provided to the main body 96, and the spindle 92 rotates as a driving force is transmitted through the transmission mechanism. The roll body 11 has the hollow core, and the spindle 92 has a portion configured to engage with an inner surface of the hollow core of the roll body 11. According to the above configuration, when the spindle 92 rotates, the roll body 11 rotates integrally. It should be noted that the above-described configuration of enabling the rotation of the roll body 11 in association with the rotation of the spindle 92 is only an example. That is, a configuration of enabling the rotation of the roll body 11 in association with the rotation of the spindle motor 92 is not necessarily limited to a specific one, but any possible configuration may be employed.

As shown in FIG. 3, in a state where the holder 90 is attached to the housing 14, a central portion of the spindle 92 in the front-rear direction 8 is located on a rear side with respect to a central position 14C (indicated by an arrow in FIG. 3) of the housing 14 in the front-rear direction 8.

As shown in FIGS. 3 and 4, the nip roller 93 extending in the right-left direction 9 is arranged on the inner side with respect to the curvature of the curved surface 96A of the main body 96. The nip roller 93 is arranged on an upper rear side with respect to the spindle 92. A right end of the nip roller 93 is rotatably supported by the right supporting member 98, while a left end of the nip roller 93 is rotatably supported by the left supporting member 98. The nip roller 93 is configured to rotate about an axis extending in the right-left direction 9.

In a state where the nip roller 93 is supported by the supporting members 98, the nip roller 93 is movable, in the front-rear direction 9, between a holding position shown by solid lines and a non-holding position shown by broken lines in FIG. 3. The front-rear movement of the nip roller 93 is performed as a driving force is transmitted from a motor (not shown) or a magnet valve.

It is noted that a configuration of enabling the nip roller 93 to move between the holding position and the non-holding position is not necessarily limited to a specific configuration, but any suitable configuration may be employed. An example of possible configurations will be described below. Each of the two supporting members 98 has a groove cut along the direction of movement of the nip roller 93. Both ends of the shaft of the nip roller 93 are inserted into the grooves, thereby the shaft of the nip roller 93 being slidably supported. There is further provided a cam, which is rotated by the driving force from a motor (not shown) of the main body, such that the cam is in contact with the shaft of the nip roller 93, and the rotation of the cam causes the shaft of the nip roller 93 to move along the grooves between the holding position and the non-holding position.

When the nip roller 93 is located at the holding position, the nip roller 93 and another nip roller 94 hold the sheet 11A therebetween. The nip roller 93 at the non-holding position is spaced from the nip roller 94, and a distance between the nip roller 93 and the nip roller 94 is much greater than the thickness of the sheet 11A. Therefore, when the nip roller 93 is located at the non-holding position, the nip roller 93 and the nip roller 94 do not hold the sheet 11A therebetween.

The nip roller 94 is provided to the main body 96 of the holder 90. The nip roller 94 is located on a rear side with respect to the nip roller 93. The nip roller 94 is configured to rotate about an axis extending in the right-left direction 9. A part of the nip roller 94 is located on a rear side with respect to the curved surface 96A of the main body 96 (see FIG. 3). A front part of the nip roller 94 is slightly protruded with respect to the curved surface 96A. The front part of the nip roller 94 protruded from the curved surface 96A is in contact with the nip roller 93 when the nip roller 93 is located at the holding position. The nip roller 94 is rotated as a rotating force is transmitted from a motor (not shown) arranged in the inner space of the housing 14. As shown in FIG. 3, in a state where the holder 90 is attached to the housing 14, the nip rollers 93 and 94 and the guide roller 20 are located on the rear side with respect to the spindle 92. In addition, in the state where the holder 90 is attached to the housing 14, the nip rollers 93 and 94 are located on an upper side, in the up-down direction 7, with respect to a central axis of the spindle 92 and on a downside, in the up-down direction 7, with respect to the guide roller 20.

As shown in FIG. 4, a mark 100 is formed on an upper end portion of the curved surface 96A. The mark 100 is formed at an approximately central part, in the right-left direction 9, of the upper end portion of the curved surface 96A. According to the present embodiment, the mark 100 is a down-pointing triangle as shown in FIG. 4. The position indicated by the mark 100 (in this embodiment, a position indicated by a bottom vertex of the down-pointing triangle) is a position of a leading end of the sheet 11A unwound from the roll body 11. It is noted that the mark 100 may be formed by embossing or other unevenness, or may be printed by ink. Alternatively, the mark 100 may be formed by a sticker with the mark 100 printed thereon may be affixed to the curved surface 96A.

Controller

Figure 5:
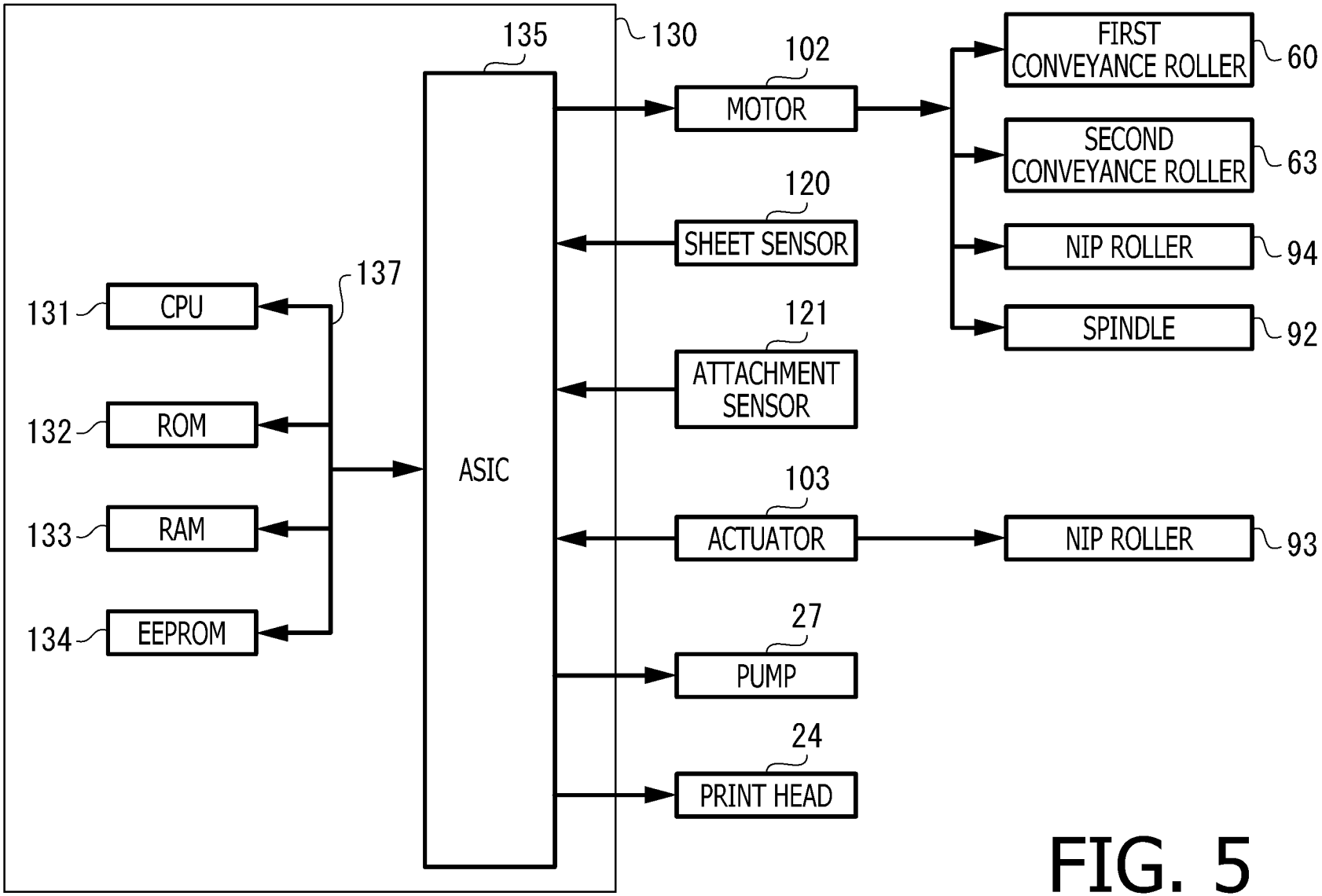
FIG. 5 is a block diagram schematically showing a hardware configuration of the image recording apparatus.
Figure 6:
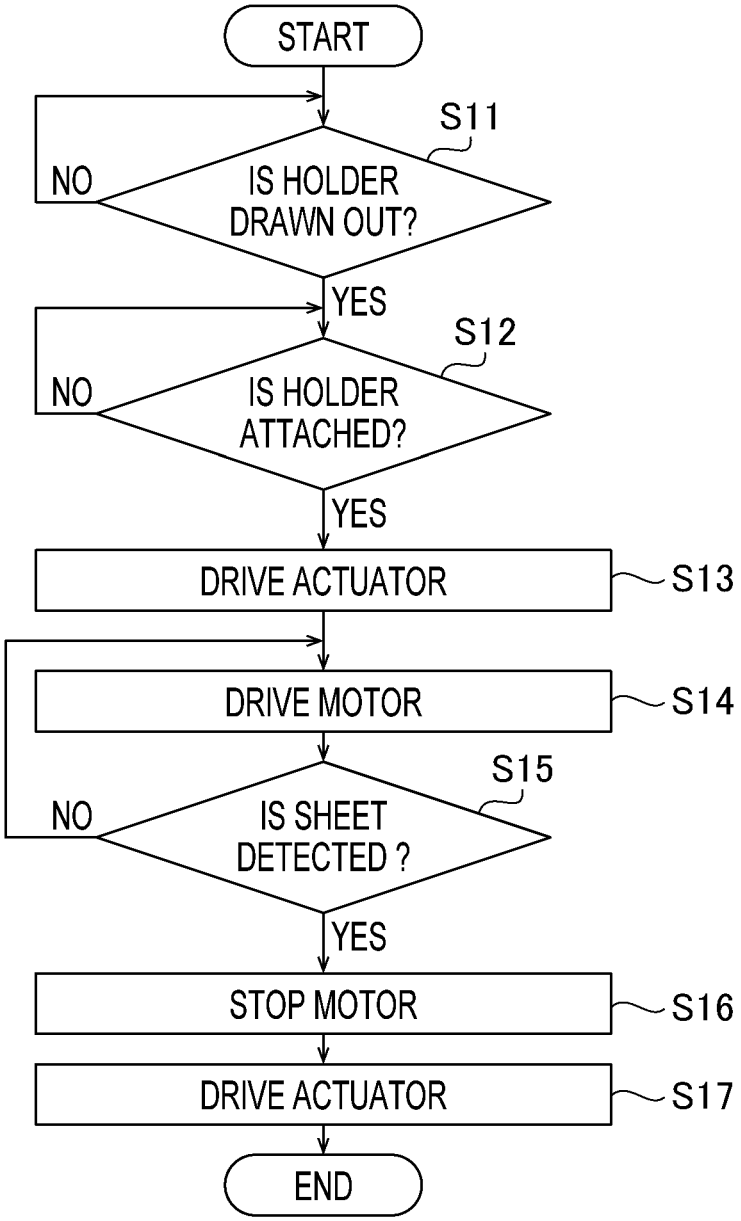
FIG. 6 is a flowchart illustrating a replacement process.

As shown in FIG. 5, the controller 130 includes a CPU 131, a ROM 132, a RAM 133, an EEPROM 134 and an ASIC 135, which are connected via an internal bus 137. The ROM 132 stores a program, which causes, when executed by the CPU 131, the image recording apparatus 10 to perform various processes. The ROM 132 further stores an upper limit UV and a lower limit LV, which are retrieved during a conveyance control described later. The RAM 133 is used as a storage area in which data and signals, which are used when the CPU 131 executes the above program are temporarily stored, or as a working area used when data processing is performed. The EEPROM 134 stores setting information and/or flags which should be retained after the information recording apparatus 10 is powered off.

The motor 102 is connected to the ASIC 135. The ASIC 135 is configured to generate a driving signal to rotate the motor 102, and controls the motor 102 based on the driving signal. The motor 102 is configured to rotate forwardly and backwardly based on the driving signal transmitted from the ASIC 135. For example, the controller 130 controls the driving of the motor 102, thereby driving respective rollers and the spindle 92.

Further, an actuator 103 is connected to the ASIC 135. According to the present embodiment, the actuator 103 may be a motor or an electromagnetic valve. The actuator 103 may be configured to be driven by the driving signal transmitted from the ASIC 135. Then, a driving force is transmitted from the actuator 103 to the cam described above to move the nip roller 93 to the holding position or the non-holding position.

Furthermore, the sheet sensor 120 is connected to the ASIC 135. The controller 130 detects whether the sheet 11A is present or absent at a position of the sheet sensor 120 based on a detection signal output by the sheet sensor 120. The controller 130 further controls the print head 24 to eject ink droplets from the nozzles 30.

The attachment sensor 121 is connected to the ASIC 135. The controller 130 is configured to detect whether the holder 90 is attached to the housing 14 based on the detection signal output by the attachment sensor 121.

Operation of Image Recording Apparatus

Hereinafter, an image recording operation of the image recording apparatus 10 will be described.

When receiving the print data, the image recording apparatus 10 controls the motor 102 to rotate the spindle 92, the guide roller 20, the first conveyance roller 60 and the second conveyance roller 62. At this stage, the nip roller 93 is located at the non-holding position.

Accordingly, the leading end of the sheet 11A of the roll body 11 is fed toward a position below the print head 24. A surface of the sheet 11A facing the print head 24 is an outer surface when wounded as the roll body 11. The image recording apparatus 10 controls the motor to rotate respective rollers to feed the sheet 11A, while causes the print head 24 to eject ink droplets toward the sheet 11A based on the print data. The ink droplets ejected from the print head 24 adhere onto the sheet 11A supported on the platen 25.

In response to the completion of the printing based on the print data, the sheet is conveyed until a printed portion of the sheet 11A is discharged from the housing 14 through the discharge opening 13. Thereafter, the image recording apparatus 10 controls the motor 102 to stop rotating the spindle 92, the guide roller 20, the first conveyance roller 60, and the second conveyance roller 62.

Replacement Operation

Hereinafter, an operation to replace the roll body 11, the tanks 70 and the waste tank 72 will be described. Regardless of whether the roll body 11, the tank 70 or the waste tank 72 is replaced, the operation of the holder 90 is the same. Accordingly, only an operation of replacing the roll body 11 will be described as an example.

When the sheet is used for printing and the sheet of the roll body 11 held by the spindle 92 is completely unwound, the roll body 11 is to be replaced by the user. In the replacement operation of the roll body 11, the user holds the finger grip 101 of the holder 90 attached to the housing 14 and pulls out the holder 90 frontward (i.e., in the front-rear direction 8). In this way, the holder 90 is slidably drawn out from the housing 14 through the drawing opening 18, as shown in FIG. 2. Similarly, when the tank 70 becomes empty after the ink is used for printing, or when the waste tank 72 is filled with almost maximum storage amount of the ink, the user pulls out the holder 90 from the housing 14.

The controller 130 determines that the holder 90 is drawn out of the housing 14 based on the signal output by the attachment sensor 121 (S11: YES). Further, as the holder 90 is drawn frontward from the housing 14, the joints 75 are disengaged from the joint receivers.

The holder 90 may be completely drawn out from the housing 14 as shown in FIG. 4, or partially drawn out from the housing 14 to the extent sufficient to enable the user to set a new roll body 11 to the spindle 92. In a case where the holder 90 is drawn from the housing 14, the spindle 92 is exposed to the outside of the housing 14. Similarly, in a case where the tank 70 or the waste tank 72 is to be replaced, the holder 90 may be drawn from the housing 14 to the extent sufficient to enable the user to replace the tank 70 or the waste tank 72.

The user may hold the used roll body 11 together with the spindle 92 from the above, and remove the same from the holder chassis 91. Then, the user may load a new roll body 11 to the spindle 92. Thereafter, the user may attach the new roll body 11, which is loaded onto the spindle 92, to the holder chassis 91, unwind the sheet 11A from the roll body 11 and make the sheet 11A pass through between the nip rollers 93 and 94. Then, the user unwinds the sheet 11A until the leading end of the sheet 11A reaches the position indicated by the mark 100.

After that, when the user attaches the holder 90 to the housing 14 by inserting the same through the drawing opening 18, the controller 130 determines that the holder 90 is attached to the housing 14 based on the signal output from the attachment sensor 121 (S12: YES). When determining that the holder 90 is attached to the housing 14, the controller 130 drives the actuator 103 (S13). Then, the nip roller 93 is moved from the non-holding position to the holding position, thereby the sheet 11A being sandwiched and held between the nip rollers 93 and 94. In this state, the controller 130 drives the motor 102 (S14) to rotate the nip roller 94, the guide roller 20 and the first conveyance roller 60. In this way, the sheet 11A unwound from the roll body 11 is led to the first conveyance roller pair 54 with being guided by the guide member which defines the conveyance path 22, and sandwiched and held by the first conveyance roller pair 54.

As the leading end of the sheet 11A sandwiched by the first conveyance roller pair 54 is conveyed in the conveyance path, the sheet sensor 120 outputs the signal indicating the presence of the sheet 11A. When the controller 130 detects the presence of the sheet 11A based on the sensing signal output from the sheet sensor 120 (S15: YES), the controller 130 stops the motor 102 (S16). Further, the controller 130 drives the actuator 103 to move the nip roller 93 from the holding position to the non-holding position (S17).

Effects of Illustrative Embodiment

According to the present embodiment, all or any of the roll body 11, the tank 70 and the waste tank 72 can be replaced simply by pulling out the holder 90 from the housing 14. Therefore the operation performed by the user for replacing consumable supplies can be unified. Furthermore, according to the above-described configuration, even if the spindle 92 supporting the roll body 11 is arranged rearward, the roll body 11 can be set easily. Since the holder 90 is drawn frontward from the housing 14, the roll body 11 can be exchanged easily.

Furthermore, in a state where the holder 90 is attached to the housing 14, the nip rollers 93 and 94, and the guide roller 20 are located on the rear side with respect to the spindle 92. Therefore, the conveyance path 22 can be shortened, thereby the image recording apparatus 10 being downsized.

In addition, since the nip roller 93 is located at the holding position, the sheet 11A can be conveyed toward the first conveyance roller pair 54 during the setting process. Further, since the nip roller 93 is located at the non-holding position, the accuracy of conveying the sheet 11A is increased as the holding power of the nip rollers 93 and 94 does not affect the conveyance of the sheet 11A by the first conveyance roller pair 54 and the second conveyance roller pair 55.

In a state where the holder 90 is attached to the housing 14, a part of the guide roller 20 located at the first position is arranged on a lower side with respect to an upper end of the holder outer wall 95. Therefore, the image recording apparatus 10 can be downsized. It is noted that the first position and the second position are merely names indicating relative positional relationship, and it does not matter that which is the first position and which is the second position. It is noted that the entire guide roller 20 located at the first position may be arranged on the lower side with respect to the upper end of the holder outer wall 95.

Since the multiple tanks 70 are arranged in the right-left direction 9, a layout efficiency of the same in conjunction with the waste tank 72 and the spindle 92 is relatively high, and the image recording apparatus 10 may easily be downsized.

The holder 90 has the holder outer wall 95 forming a part of the front surface of the housing 14. Therefore, a cover to open and close the drawing opening 18 when the holder 90 is attached to or detached from the housing 14 is unnecessary and the replacement operation can be performed easily.

Since the holder outer wall 95 is formed with the window 19, in a state where the holder 90 is attached to the housing 14, the user can visually check the remaining amount of the ink held in the tank 70.

Since the right wall 35 of the housing 14 is formed with the window 39, in a state where the holder 90 is attached to the housing 14, the user can visually check the state of the roll body 11.

Since the spindle 92 is detachably attached to the main body 96 of the holder 90, the user can set the roll body 11 to the holder 90 easily.

Since the mark 100 is formed on the curved surface 96A of the holder 90, the user can easily set the sheet 11A unwound from the roll body 11.

Modifications

According to the illustrative embodiment described above, the holder 90 is configured to be drawn frontward from the housing 14. Instead of such a configuration, the holder 90 may be configured to be pulled out in another direction, e.g., rightward. It is noted that the holder 90 may not have the holder outer wall 95. In such a case, a cover may be provided to the housing 14 for opening and closing the drawing opening 18.

It is noted that the holder 90 may be provided with a single tank 70 instead of a plurality of tanks 70. Further, the tank 70 does not need to be of a cartridge type detachably attached to the holder 90, but one fixed to the holder 90. In such a case, a filling opening may be provided to the tank 70 and ink is supplied to the tank 70 via the filling opening. It is noted that the holder 90 does not need to have both the tank 70 and the waste tank 72. It is sufficient that at least one of the tanks 70 and the waste tank 72 may be provided to the holder 90.

According to the above-described embodiment, the sheet 11A unwound from the roll body 11 is conveyed upward inside the holder 90. Instead such a configuration, the sheet 11A unwound from the roll body 11 may be conveyed rearward and then upward.

According to the illustrative embodiment, the upper side, the right side and the left side of the holder chassis 91 are opened. The configuration may be modified such that a cover member to cover the upper side and the front side of the holder chassis 91 may be provided. For example, such a cover may be detachably attached to the holder chassis 91, and the cover may be detached from the holder chassis 91 when the roll body 11 is replaced.

Instead of the nip rollers 93 and 94 provided in the holder 90, urging members configured to urge both side ends, in the right-left direction 9, of the sheet 11A from the front side toward the curved surface 96A may be provided. When such urging members are provided, a pickup roller configured to feed the leading end of the sheet 11A toward the guide roller 20 may additionally be provided to the holder 90.

The arrangement, on the front wall 31 of the image recording apparatus 10, of the discharge opening 13 and the operation panel 17 can be changed. The discharge opening 13 or the operation panel 17 may be arranged on a wall other than the front wall 31. For example, the discharge opening 13 may be provided to the upper wall 33. In such a case, the sheet 11A on which an image has been printed may pass through the discharge opening 13 and is discharged to an upward or obliquely upward direction.

Instead of the guide roller 20, a guide member having a curved surface that contacts the sheet 11A to guide the sheet 11A may be provided.

According to the illustrative embodiment, the first conveyance roller pair 54 and the second conveyance roller pair 55 hold and convey the sheet 11A in the conveyance path 22. It is noted that another conveyance member such as a conveying belt may be used instead of such a configuration.

Optionally, a heater configured to heat at least one of the sheets and the ink may be provided at a downstream position with respect to the print head 24 along the conveyance path 22 to expedite the drying of the ink. Alternatively, ink containing UV-curing resin may be used. In such a case, a UV irradiator may be provided at a downstream position with respect to the print head 24.

According to the illustrative embodiment, the print head 24 employing the inkjet printing technique is used. Alternatively, the image recording apparatus may be one employing an electrophotographic imaging technique or one utilizing a thermal head.

According to the illustrative embodiment, the roll body 11 is held by the spindle 92. It is noted that a stick-like supporting member rotatably supporting the roll body is not necessarily a rotatable member such as the spindle 92. For example, a cylindrical solid or hollow member having an outside diameter smaller than an inside diameter of a core of the roll body 11 may be used as the non-rotatable supporting member.

According to the illustrative embodiment, the image recording apparatus 10 is used with the front wall 31 and the rear wall 32 of the housing 14 extending in the up-down direction 7 and the right-left direction 9, respectively. It is noted that a usage posture of the image recording apparatus 10 does not need to be limited to the posture according to the above-described embodiment.

It is noted that the holder 90 is an example of a drawer according to aspects of the present disclosures. The window 19 is an example of a first window according to aspects of the present disclosures. The other window 39 is an example of a second window according to aspects of the present disclosures. Further, the waste tank 72 is an example of a liquid container according to aspects of the present disclosures. The tank 70 is an example of a liquid container according to aspects of the present disclosures. Further, the nip roller 93 is an example of a sheet holding member according to aspects of the present disclosures.

What is claimed is:

1. An image recording apparatus, comprising:

a housing;

a holder configured to be attached to and drawn from the housing;

a supporting member supported by the holder and configured to support a sheet roll;

a liquid container supported by the holder and configured to hold liquid;

a conveyance mechanism, supported by the housing, and arranged in an inner space of the housing and configured to convey a sheet unwound from the sheet roll;

a print head, supported by the housing, and arranged in the inner space of the housing and configured to record an image on the sheet conveyed by the conveyance mechanism;

a sheet holding member, which is supported by the holder, the sheet holding member being configured to hold the sheet unwound from the sheet roll and to convey the sheet toward the conveyance mechanism; and a guide member arranged downstream, in the conveyance direction, with respect to the sheet holding member, and arranged upstream, in the conveyance direction, with respect to the conveyance mechanism, wherein the sheet holding member and the guide member are located on a rear side with respect to a position at which the supporting member is located in an attached state where the holder is attached to the housing, wherein the liquid container includes at least one of tanks configured to hold liquid to be provided to the print head and a waste tank configured to pool liquid discharged from the print head, wherein, in the attached state where the holder is attached to the housing, the liquid container is located on a front side with respect to the supporting member, wherein the housing has a discharge opening from which a portion of the sheet on which an image is formed is discharged, and wherein the discharge opening is arranged on the front side with respect to the supporting member.

2. The image recording apparatus according to claim 1, wherein the sheet holding member is configured to move between a holding position, at which the sheet holding member holds the sheet, and a non-holding position, at which the sheet holding member does not hold the sheet.

3. The image recording apparatus according to claim 2, further comprising:

a sensor arranged on a downstream side with respect to the conveyance mechanism and configured to output a detection signal indicating whether the sheet unwound from the sheet roll is present;

an actuator configured to move the sheet holding member; and a controller configured to perform determining whether the sheet is located on the downstream side, in the conveying direction, with respect to the conveyance mechanism based on detection signal output by the sensor, and in response to determining that the sheet is located on the downstream side, in the conveyance direction, with respect to the conveyance mechanism, driving the actuator to move the sheet holding member to the non-holding position.

4. The image recording apparatus according to claim 1, wherein the holder comprises an outer wall forming an outer surface of the housing, wherein the guide member is configured to move between a first position and a second position, and wherein, at least a part of the guiding member located at one of the first position and the second position is placed on a lower side with respect to an upper end of the outer wall in the attached state where the holder is attached to the housing.

5. The image recording apparatus according to claim 1, wherein the holder is configured to be drawn frontward.

6. The image recording apparatus according to claim 1, wherein the liquid container includes a plurality of tanks, and wherein the plurality of tanks are arranged in a right-left direction.

7. The image recording apparatus according to claim 4, wherein the outer wall is formed with a first window configured to transmit light.

8. The image recording apparatus according to claim 1, wherein the outer wall is formed with a second window configured to transmit light, the second window being arranged beside the supporting member in a state where the holder is attached to the housing.

9. The image recording apparatus according to claim 1, wherein the supporting member is detachably attached to the holder.

10. The image recording apparatus according to claim 1, wherein the holder is formed with a mark indicating a position of a leading end of the sheet unwound from the sheet roll supported by the supporting member.

* * * * *